United States Patent [19]

Yasuda et al.

[11] Patent Number: 4,504,541

[45] Date of Patent: Mar. 12, 1985

[54] ANTIMICROBIAL FABRICS HAVING IMPROVED SUSCEPTIBILITY TO DISCOLORATION AND PROCESS FOR PRODUCTION THEREOF

[75] Inventors: Kazuo Yasuda, Otsu; Kyo Funabashi, Nagaokakyo; Akiyoshi Chiyoda, Toyonaka, all of Japan

[73] Assignee: Toyo Boseki Kabushiki Kaisha, Osaka, Japan

[21] Appl. No.: 573,766

[22] Filed: Jan. 25, 1984

[51] Int. Cl.[3] ..... C08L 83/04

[52] U.S. Cl. ..... 428/264; 428/254; 428/279; 428/290; 428/447; 428/907

[58] Field of Search ..... 428/264, 254, 279, 290, 428/447, 907

[56] References Cited

U.S. PATENT DOCUMENTS 4,436,856 3/1984 Huhn et al. ..... 428/447

*Primary Examiner*—Marion E. McCamish

[57] ABSTRACT

Antimicrobial fabrics having improved susceptibility to discoloration, which comprises a fabric treated with a quaternary ammonium base-containing organosilicone, wherein the quaternary ammonium cation contained in the organosilicone is at least partially sealed with an anionic surfactant, and a method for the production thereof. The antimicrobial fabrics of the present invention have excellent resistance to discoloration such as lowering of whiteness and yellowing with excellent durability of the antimicrobial activities.

6 Claims, 1 Drawing Figure

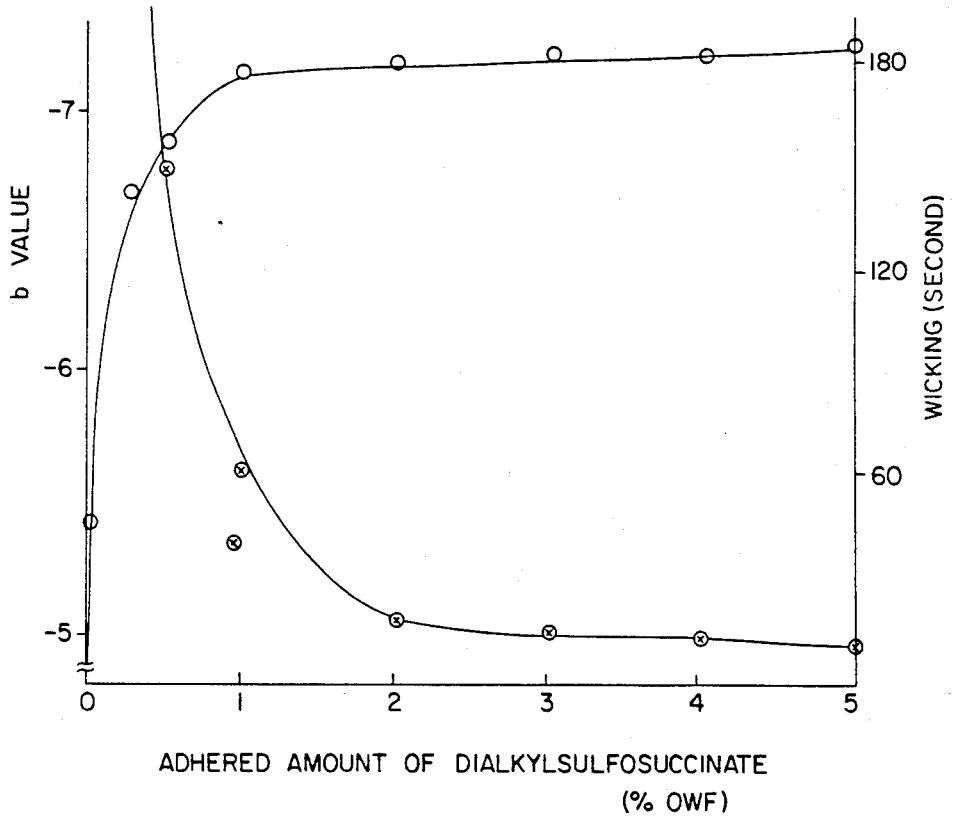
b VALUE
-7
-6
-5
WICKING (SECOND)
180
120
60
0
1
2
3
4
5
ADHERED AMOUNT OF DIALKYLSULFOSUCCINATE
(% OWF)

ANTIMICROBIAL FABRICS HAVING IMPROVED SUSCEPTIBILITY TO DISCOLORATION AND PROCESS FOR PRODUCTION THEREOF

The present invention relates to antimicrobial fabrics having improved susceptibility to discoloration and process for the production thereof. More particularly, it relates to antimicrobial fabrics having improved resistance against discoloration, such as lowering of whiteness or yellowing of fluorescent dyed products and having improved durability.

Various microorganisms such as fungi and bacteria live in atmosphere and give harmful effects on human body and fabrics. For instance, fungi and bacteria grow and propagate on a wide range of fabrics such as various clothes, fabric products in bed room, various interior products and exterior products by taking as the nutrients the components contained in human sweat and foods and/or drinks which are adhered onto the fabrics, and as a result, the fabrics are occasionally discolored with excreta of the microorganisms, or the fibers themselves are embrittled therewith. Moreover, such excreta of the microorganisms cause bad smell, which is problem from hygienic viewpoint, too. Growth and propagation of bacteria or other microorganisms adhered on the fabrics give also bad effect on health of human body, particularly in the fabrics such as socks, underwear, casual wear, and further sheets and covering cloths on bed.

In order to eliminate such a problem of microorganisms, it has hitherto been known to treat the fabrics with organic tin compounds, organic mercury compounds, halogenated phenol compounds, quaternary ammonium salt-containing cationic surfactants, quaternary ammonium base-containing vinyl polymer, or the like. However, these known methods are not necessarily satisfactory because of toxicity to human body, environmental pollution due to treatment wastes, less durability, discoloring of the fabrics, or the like. Among the above treatments, an attention is given to the treatment with a quaternary ammonium base-containing cationic surfactant in view of less toxicity (cf. Japanese Patent Publication No. 45485/1981). However, this agent is also disadvantageous in the less durability and inferior feeling of the products treated therewith, and further, it has drawbacks that when fluorescent dyed products are treated with this agent, most fluorescent whitening agents are an anionic group-containing dye and hence loose their fluorescence to result in yellowing of the products.

The present inventors have intensively studied on an improved fabric having antimicrobial activities without drawbacks as in the known techniques, i.e. having good durability and improved resistance against discoloration, i.e. with neither lowering of whiteness nor yellowing. As a result, it has been found that the desired antimicrobial fabrics can be obtained by treating the fabrics with a quaternary ammonium base-containing organosilicone, followed by sealing at least partially the quaternary ammonium cation in the organosilicone with an anionic surfactant.

An object of the present invention is to provide improved antimicrobial fabrics with improved resistance to discoloration. Another object of the invention is to provide improved fabrics having various advantages such as improved durability of the effect in washing, improved resistance to discoloration such as lowering of whiteness and yellowing and also improved moisture absorbability, and further excellent feeling, in addition to the high antimicrobial activities owing to the antimicrobial quaternary ammonium base-containing organosilicone. A further object of the invention is to provide a process for the production of the antimicrobial fabrics as set forth above. These and other objects and advantages of the present invention will be apparent to persons skilled in the art according to the following description.

The antimicrobial fabrics having improved susceptibility to discoloration of the present invention is obtained by treating the fabrics with a quaternary ammonium base-containing organosilicone, wherein the quaternary ammonium cation contained in the organosilicone is at least partially sealed by the treatment with an anionic surfactant.

BRIEF DESCRIPTION OF THE DRAWING

The single FIGURE of the drawing shows the relation of the adhered amount of dialkylsulfosuccinate, whiteness (b value) and water absorbability as measured in the runs of Example 3.

DETAILED DESCRIPTION

The quaternary ammonium base-containing organosilicone used in the present invention include diorganopolysiloxane having siloxane unit containing a quaternary ammonium base, which is obtained by converting a tertiary nitrogen-containing group (e.g. dialkylaminoalkyl group) into the corresponding quaternary ammonium group, and organosilicone of the formula:

$$(R)_3Si—R'—N^+(R'')_n(R''')_{3-n}X^-$$

wherein R is an alkoxy group having 1 to 20 carbon atoms, a halogen atom, an acyl group such as an alkanoyl group having 2 to 18 carbon atoms, hydroxy or an alkyl having 1 to 20 carbon atoms, provided that at least two of the R groups are other than hydroxy and alkyl group; R' is a divalent hydrocarbon group having 1 to 20 carbon atoms, such as a straight or branched alkylene having 1 to 20 carbon atoms, (e.g. $—CH_2—$, $—CH_2CH_2—$, $—(CH_2)_3—$, $—(CH_2)_6—$, $—C_{18}H_{37}—$), phenylene ( 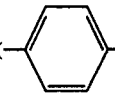 ), a phenylalkylene (e.g. 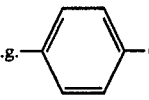 $—CH_2—$,

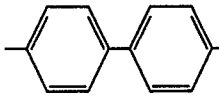 $—CH_2—$), or an oxygen- and/or nitrogen-containing divalent hydrocarbon group having 1 to 20 carbon atoms, such as $—CH_2CH_2—O—CH_2CH_2—$, $$—CH_2CH_2\underset{\underset{OH}{|}}{C}HCH_2CH_2—,$$

-continued $$-CH_2CH_2CH_2-O-CH_2\underset{\underset{OH}{|}}{C}H-CH_2-,$$

$$-CH_2CH_2CH_2NHCH_2CH_2-, \text{ or}$$

$$-CH_2CH_2CH_2-\underset{\underset{C_2H_5}{|}}{N}-CH_2CH_2-;$$

R'' is an alkyl group having 1 to 6 carbon atoms; R''' is an alkyl group having 1 to 20 carbon atoms, an alkenyl group having 2 to 20 carbon atoms, or an aralkyl group having 7 to 10 carbon atoms such as benzyl, phenethyl; n is an integer of 1 to 3; X is an anion such as chlorine or bromine. Suitable examples of the above latter organosilicone is a compound of the formula:

$$[(CH_3O)_3Si(CH_2)_3-\overset{\overset{CH_3}{|}}{\underset{\underset{CH_3}{|}}{N}}-C_nH_{2n+1}]^+ Cl^-$$

wherein n is an integer of 16 to 20.

These organosilicone compounds can form a film coating on fibers in the fabrics, and further, in case of the treatment with the above latter compounds, the quaternary ammonium cation is introduced therein by the reaction with the compound and the active hydrogen contained in the fibers, by which the fabrics thus treated show excellent antimicrobial activities against various fungi and bacteria, for example, fungi such as *Aspergillus niger* (bread mold), Penicillia (green mold), *Aspergillus oryzae,* Chaetomium, *Rhizopus nigricans* etc., bacteria such as *Escherichia coli, Staphylococcus aureus,* Corynebacterium, Bacilli, Micrococci, etc.

The fiber materials for the fabrics in the present invention are not specified, but include various materials such as natural fibers (e.g. cotton, hemp, wool, silk), regenerated fibers (e.g. viscose rayon, polynosic rayon, copper ammonium rayon), semi-synthetic fibers (e.g. acetate fibers), promix fibers (e.g. protein-acrylonitrile), sole, mixed or conjugate fibers of synthetic fibers (e.g. polyamide fibers, acryl fibers, polyester fibers, polyolefin fibers), and further various threads, textiles, nonwoven fabrics, rugs, sewn products which are obtained from the above fabrics. Besides, composite products of these fibers and other materials are also included.

These fabrics are firstly treated with the organosilicone as mentioned above in a usual manner, for example, treatment in an aqueous solution of the organosilicone; treatment in a pad bath, followed by drying; treatment by spraying the aqueous solution, followed by drying; treatment in a pad bath, followed by steam treatment; among which the treatment in an aqueous solution is particularly suitable. After the treatment, the fabrics may optionally be subjected to heat treatment. In case of the treatment in an aqueous solution, it is usually carried out by dipping the fabrics to be treated in a bath (liquor ratio, 1:5–100 by weight) at a temperature of from room temperature to 80° C., preferably 40° to 70° C., for 30 minutes or longer, by which the fabrics exhaust the organosilicone sufficiently. After the exhaustion treatment, the fabrics are dried with hot air of 80° C. or higher. The organosilicone is adhered onto the fibers of the fabrics in an amount of 0.1 to 3% by weight (as the solid components), preferably 0.5 to 1% by weight, based on the weight of the fabrics. In the treatment with an organosilicone, there may be used together perfluoroalkyl-containing water or oil repellants, organopolysiloxanes containing no quaternary ammonium cation, polyether polyester block copolyester stainproofing agents, etc.

The fabrics thus treated merely with the organosilicone have excellent antimicrobial activities and have excellent durability of the activities even after washing at home or dry cleaning, but can not show sufficient durability when they are exposed to severe sterilization treatment such as treatment with chlorine (50 ppm) at 70° C. for 10 minutes which is usually done in hospitals or in case of high temperature treatment in autoclave. Moreover, when whitening products, such as fluorescent dyed cellulose fiber products are treated with the organosilicone, the products show occasionally lowering of whiteness or yellowing during storage thereof to result in significant lowering of the product value. This reason is not made clear, but is assumed that it is caused by bad compatibility between the compound and the fluorescent dyes. Besides, the mere treatment with the organosilicone is not suitable for towel, sheets or underwear because the fabrics become hydrophobic. These drawbacks can be eliminated by further treatment with an anionic surfactant.

Thus, it is essential in the present invention to treat the organosilicone-treated fabrics with an anionic surfactant. The aninonic surfactant used in the present invention includes, for example, a higher fatty acid salt of the formula: $R^1COOM$ wherein $R^1$ is an alkyl having 12 to 18 carbon atoms and M is an alkali metal; a higher alcohol sulfate of the formula: $R^2OSO_3M$ wherein $R^2$ is an alkyl having 8 to 18 carbon atoms and M is as defined above; a higher alkylsulfonate of the formula: $R^3SO_3M$ wherein $R^3$ is an alkyl having 8 to 20 carbon atoms and M is as defined above; a sulfated oil (e.g. sulfated castor oil); sulfonated fatty acid ester, such as sulfonated fatty acid ester of the formula:

$$R^4-\underset{\underset{SO_3M}{|}}{C}H-COOR^5$$

wherein $R^4$ is an alkyl having 1 to 18 carbon atoms, $R^5$ is allyl or an alkyl having 1 to 18 carbon atoms, and M is as defined above, and a dialkyl sulfosuccinate of the formula:

$$\begin{array}{l} R^6OOC-CH-SO_3M \\ \quad\quad\quad\;\; | \\ R^7OOC-CH_2 \end{array}$$

wherein $R^6$ and $R^7$ are the same or different and are each an alkyl having 1 to 18 carbon atoms and M is as defined above, for example, sodium dioctyl sulfosuccinate of the formula:

$$\begin{array}{l} C_8H_{17}OOC-CH-SO_3Na \\ \quad\quad\quad\;\; | \\ C_8H_{17}OOC-CH_2 \end{array}$$

(a commercially available product of this compound: Aerosol OT, manufactured by ACC); an olefin sulfate having 8 to 20 carbon atoms; an alkylbenzenesulfonate of the formula:

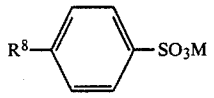

wherein $R^8$ is an alkyl having 10 to 15 carbon atoms and M is as defined above; an alkylnaphthalenesulfonate of the formula:

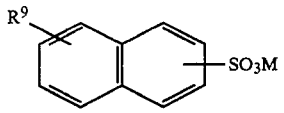

wherein $R^9$ is an alkyl having 3 or 4 carbon atoms and M is as defined above; a paraffine sulfonate having 8 to 20 carbon atoms, such as sodium oleylmethyltauride of the formula:

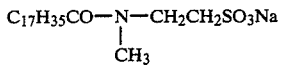

(a commercially available products of this compound: Igepon T, manufactured by IG): a higher alkylphosphate of the formula: $(R^{10}O)_n—PO(OM)_m$ wherein $R^{10}$ is an alkyl having 8 to 18 carbon atoms, n and m are each 1 or 2, provided n+m=3, and M is as defined above; or the like, which are used alone or in combination of two or more thereof. Among the above anionic surfactants, the higher fatty acid salt and sulfonated fatty acid ester, especially the dialkyl sulfosuccinate, are preferable in view of their excellent effect for prevention of yellowing and excellent moisture absorbability improvement.

The anionic surfactants are used in an amount sufficient for sealing at least a part of, preferably 50% or more of, more preferably all of, the cationic groups contained in the organosilicone, usually in an amount of 0.5 to 2 equivalents of the anionic group to the cationic group. When an excess amount of the anionic surfactant is used, i.e. an amount of more than the amount for sealing the cationic groups (for example, 1.5 times or more as much as the amount for sealing them, e.g. 1.5 to 2 equivalents of the anionic group to the cationic group) is used, the moisture- and sweat-absorbability of the products is more improved. It is also important in the present invention that the treatments with the organosilicone and with the anionic surfactant are carried out in this order, because even if the fabrics are simultaneously treated with both treating agents in the same bath, no desired effect can be obtained.

The treatment with an anionic surfactant is also carried out in the same manner as in the treatment with an organosilicone, i.e. by dipping in a solution of an anionic surfactant or by the treatment in a pad bath. However, when the treatment of fabrics with an organosilicone is carried out by dipping in a solution thereof (dipping method), it is preferable to do the treatment with an anionic surfactant in such a manner that after the organosilicone is sufficiently exhausted to the fibers of fabrics, an anionic surfactant and optionally other salts and additives are added to the same bath, and the organosilicone-treated fabrics are treated in said bath for several minutes to several tens of minutes. Thus, in such a manner, the operation is so simple and no special equipment is required. This is also one of the advantages of the present invention. On the other hand, when the treatment of fabrics with an organosilicone is done by pad method, the treatment with an anionic surfactant is also preferably carried out by the pad method, followed by drying. However, the method of the present invention is not limited to such treatment manners, but it may also be adopted to do the treatments in such a manner that the treatment with an organosilicone is done by the dipping method and the subsequent treatment with an anionic surfactant is done by the pad method, and vice versa.

The fabrics treated with an anionic surfactant of the present invention is also advantageously improved in anti-chlorine property.

The present invention is illustrated by the following examples but is not construed to be limited thereto.

EXAMPLE 1

Cotton-milling knit fabric which was scoured, bleached and fluorescent-dyed was charged in a water in a wince dyeing machine (liquor ratio, 1:20), whereto a qaternary ammonium base-containing organosilicone of the formula shown hereinafter [(1.2% based on the weight of the fabric (abbreviation: owf)] was added portionwise over a period of 10 minutes while running the machine. The bath temperature was raised to 50° C. over a period of 15 minutes, and the fabric was treated at the temperature for 15 minutes. After adding thereto soap (1.2% owf), and the treatment was continued for 15 minutes. After the treatment, the fabric was dehydrated by centrifugation and dried at 120° C. with a short loop dryer, by which the sterilization treatment was effected. For comparison purpose, a reference fabric was obtained by repeating the above procedure except that no soap was used.

The fabrics thus treated were tested as to their whiteness, light fastness and durability. The whiteness was tested by measuring L, a and b with a colorimeter (manufactured by Nippon Denshoku K.K.) and evaluated based on the data. The light fastness was measured by irradiating the fabrics with a fadeometer for 1, 3 and 5 hours, and the discoloration was compared. The durability was measured by subjecting the fabrics to be tested to washing 50 times with a home-washing machine, followed by treating with an aqueous solution of 50 ppm of sodium hypochlorite at 70° C. for 10 minutes and then subjecting the test sample thus treated to measurement of antimicrobial activities by the anti-fungal activity measuring method as set forth in Japanese Industrial Standard (JIS) Z-2911. The results are shown in Table 1, wherein o: excellent in antimicrobial activities, Δ: good in the same, and x: bad in the same.

As is shown in the table, the fabric subjected to the antimicrobial treatment without soap showed higher b value and less whiteness in comparison with a non-treated farbic (fluorescent dyed fabric), and showed easier discoloration within a short period of time in the irradiation with a fadeometer, and further showed less antimicrobial activities in the treatment with 50 ppm sodium hypochlorite solution at 70° C. for 10 minutes while showed good antimicrobial activities in the 50 times washing with home washing machine. On the contrary, the fabric subjected to the sterilization treatment using soap showed neither lowering of whiteness nor difference in light fastness in comparison with a non-treated fabric, and further showed excellent durability of antimicrobial activities even after the treatment with sodium hypochlorite solution.

TABLE 1

(Properties of the fabric subjected to the sterilization treatment using soap)

| Test fabrics | Properties: Whiteness L | a | b | Light resistance 1 hr | 3 hr | 5 hr | Antimicrobial activities: Non-treated | Washing × 50 | Cl—treating |
|---|---|---|---|---|---|---|---|---|---|
| Non-treated (fluorescent dyed) | 92.6 | 3.7 | −6.4 | 4–5 | 4 | 3–4 | x | x | x |
| Treatment without soap | 92.2 | 2.9 | −3.9 | 3 | 3 | 3 | | | x-Δ |
| Treatment using soap | 92.9 | 3.0 | −6.3 | 4–5 | 4 | 3–4 | | | |

$$(CH_3O)_3Si(CH_2)_3\overset{\overset{CH_3}{|}}{\underset{\underset{CH_3}{|}}{N}}^{+}-C_{18}H_{37}Cl^{-}$$

(Dow Corning ® 5700, manufactured by Dow Corning)

$$(CH_3O)_3Si(CH_2)_3\overset{\overset{C_2H_5}{|}}{\underset{\underset{C_2H_5}{|}}{N}}^{+}-C_{17}H_{35}Cl^{-}$$

EXAMPLE 2

Polyester jersy which was refined, pre-set and dyed was dipped in the same aqueous solution of a qaternary ammonium base-containing organosilicone as used in Example 1, and the temperature was raised to 60° C., and then treated for 20 minutes. To the bath was added a solfonated fatty acid ester (sodium isopropyl α-sulfostearate) (1% owf), and then it was treated for 10 minutes, dehydrated and dried. The product thus treated was tested as to the durability of antimicrobial activities in the same manner as described in Example 1. When the properties of the product treated in the bath added with the sulfonated fatty acid ester and that without using the sulfonated fatty acid ester. As a result, the former product did not show lowering of the antimicrobial activities even after the treatment with sodium hypochlorite.

EXAMPLE 3

Cotton woven fabric which was desized, refined, mercerized and fluorescent-dyed was dipped in a 1.5% by weight aqueous solution of a qaternary ammonium base-containing organosilicone having the formula as shown below in a pad bath, and squeezed to about 70% in pick up rate with a padder, and then dried to give a sterilized product adhered with about 1% owf organosilicone. The product thus treated was subjected to padding with an aqueous solution containing 0 to 5% by weight of a dialkylsulfosuccinate (i.e. sodium dioctyl sulfosuccinate, Aerosol OT, manufactured by ACC) and then dried. The relation of the adhered amount of the dialkylsulfosuccinate, whiteness (b value) and water-absorbability was measured. The results are shown in the accompanying single FIGURE of the drawing. The water-absorbability was measured by dropping water drops on the fabric thus treated while keeping it horizontally, and then counting the time till the dropped water was diffused and disappeared (wicking).

As is clear from the results, the product treated without the dialkylsulfosuccinate showed higher b value and less whiteness and was also inferior in the water-absorbability. On the other hand, when the adhered amount of the dialkylsulfosuccinate became to the same 1% owf as the amount of the organosilicone, the whiteness became equilibrium and the product showed excellent whiteness. Besides, the wicking properties became also better with increase of the amount of the anionic surfactant.

Moreover, the antimicrobial activities of the frabrics thus treated were also tested by a bioassay method, i.e. by impregnating the fabrics with a solution containing a prescribed amount of a gram-negative bacteria, allowing to stand the fabric at the same temperature as that of human body for a fixed period of time, and then measuring the number of bacteria, whereby the increase or decrease of the number of bacteria being compared. As a result, the non-treated fabric showed increase in the bacterial number, but the fabric subjected to the antimicrobial treatment showed decrease of the bacterial number. The fabric treated by the present invention showed excellent antimicrobial activities (with decrease of 95% or more of the bacterial number) regardless the treatment with the dialkylsulfosuccinate. However, when the product having less than 0.5% owf in the adhered amount of the dialkylsulfosuccinate was treated with 500 ppm sodium hypochlorite aqueous solution at 70° C. for 10 minutes as in Example 1, it showed decrease of bacterial number to less than 50%, while it could keep good durability of antimicrobail activities by the 50 times washing with a home washing machine. Thus, this also showed that the after-treatment is necessary for the durability of the antimicrobial effect.

What is claimed is:

1. An antimicrobial fabric having improved susceptibility to discoloration, which comprises a fabric treated with a quaternary ammonium base-containing organosilicone, wherein the quaternary ammonium cation contained in the organosilicone is at least partially sealed with an anionic surfactant, said organosilicone being selected from the group consisting of diorganopolysiloxane having siloxane unit containing a quaternary ammonium base which is obtained by converting a tertiary nitrogen-containing group into the corresponding quaternary ammonium group and organosilicone of the following formula:

$$(R)_3Si—R'—N^+(R'')_n(R''')_{3-n}X^-$$

wherein R is an alkoxy group having 1 to 20 carbon atoms, a halogen atom, an alkanoyl group having 2 to 18 carbon atoms, hydroxy, or an alkyl having 1 to 20 carbon atoms, provided that at least two of the R groups are other than hydroxy and alkyl group; R′ is a divalent hydrocarbon group having 1 to 20 carbon atoms, or an oxygen- and/or nitrogen-containing divalent hydrocarbon group having 1 to 20 carbon atoms; R‴ is an alkyl group having 1 to 20 carbon atoms, an alkenyl group having 2 to 20 carbon atoms, or an aralkyl group having 7 to 10 carbon atoms; n is an integer of 1 to 3; X is an anion.

2. The antimicrobial fabric according to claim 1, wherein the organosilicone compound is an organosilicone of the following formula:

$$(R)_3Si—R'—N^+(R'')_n(R''')_{3-n}X^-$$

wherein R is an alkoxy group having 1 to 20 carbon atoms, a halogen atom, an alkanoyl group having 2 to 18 carbon atoms, hydroxy, or an alkyl having 1 to 20 carbon atoms, provided that at least two of the R groups are other than hydroxy and alkyl group; R′ is a divalent hydrocarbon group having 1 to 20 carbon atoms, or an oxygen- and/or nitrogen-containing divalent hydrocarbon group having 1 to 20 carbon atoms, R″ is an alkyl group having 1 to 6 carbon atoms; R‴ is an alkyl group having 1 to 20 carbon atoms, an alkenyl group having 2 to 20 carbon atoms, or an aralkyl group having 7 to 10 carbon atoms; n is an integer of 1 to 3; X is an anion.

3. The antimicrobial fabric according to claim 2, wherein the organosilicone compound is a compound of the formula:

$$[(CH_3O)_3Si(CH_2)_3—\overset{\overset{CH_3}{|}}{\underset{\underset{CH_3}{|}}{N}}—C_nH_{2n+1}]^+ Cl^-$$

wherein n is an integer of 16 to 20.

4. A method for producing an antimicrobial fabric having improved susceptibility to discoloration, which comprises treating a fabric with a quaternary ammonium base-containing organosilicone, and then treating with an anionic surfactant, said organosilicone being selected from the group consisting of diorganopolysiloxane having siloxane unit containing a quaternary ammonium base which is obtained by converting a tertiary nitrogen-containing group into the corresponding quaternary ammonium group and organosilicone of the following formula:

$$(R)_3Si—R'—N^+(R'')_n(R''')_{3-n}X^-$$

wherein R is an alkoxy group having 1 to 20 carbon atoms, a halogen atom, an alkanoyl group having 2 to 18 carbon atoms, hydroxy, or an alkyl having 1 to 20 carbon atoms, provided that at least two of the R groups are other than hydroxy and alkyl group; R′ is a divalent hydrocarbon group having 1 to 20 carbon atoms, or an oxygen- and/or nitrogen-containing divalent hydrocarbon group having 1 to 20 carbon atoms; R″ is an alkyl group having 1 to 6 carbon atoms; R‴ is an alkyl group having 1 to 20 carbon atoms, an alkenyl group having 2 to 20 carbon atoms, or an aralkyl group having 7 to 10 carbon atoms; n is an integer of 1 to 3; X is an anion.

5. The method according to claim 4, wherein the organosilicone compound is an organosilicone of the following formula:

$$(R)_3Si—R'—N^+(R'')_n(R''')_{3-n}X^-$$

wherein R is an alkoxy group having 1 to 20 carbon atoms, a halogen atom, an alkanoyl group having 2 to 18 carbon atoms, hydroxy, or an alkyl having 1 to 20 carbon atoms, provided that at least two of the R groups are other than hydroxy and alkyl group; R′ is a divalent hydrocarbon group having 1 to 20 carbon atoms, or an oxygen- and/or nitrogen-containing divalent hydrocarbon group having 1 to 20 carbon atoms, R″ is an alkyl group having 1 to 6 carbon atoms; R‴ is an alkyl group having 1 to 20 carbon atoms, an alkenyl group having 2 to 20 carbon atoms, or an aralkyl group having 7 to 10 carbon atoms; n is an integer of 1 to 3; X is an anion.

6. The method according to claim 5, wherein the organosilicone compound is a compound of the formula:

$$[(CH_3O)_3Si(CH_2)_3—\overset{\overset{CH_3}{|}}{\underset{\underset{CH_3}{|}}{N}}—C_nH_{2n+1}]^+ Cl^-$$

wherein n is an integer of 16 to 20.

* * * * *